US010728644B2

(12) United States Patent
Kim

(10) Patent No.: US 10,728,644 B2
(45) Date of Patent: Jul. 28, 2020

(54) HOLDING STRAP FOR WIRELESS EAR-BUD STYLE EARPIECES HAVING A STEM

(71) Applicant: SPIGEN KOREA CO., LTD., Seoul (KR)

(72) Inventor: Dae-Young Kim, Seoul (KR)

(73) Assignee: SPIGEN KOREA CO., LTD., Seoul (KR)

( * ) Notice: Subject to any disclaimer, the term of this patent is extended or adjusted under 35 U.S.C. 154(b) by 0 days.

(21) Appl. No.: 15/482,485

(22) Filed: Apr. 7, 2017

(65) Prior Publication Data

US 2018/0077481 A1 Mar. 15, 2018

Related U.S. Application Data

(60) Provisional application No. 62/393,086, filed on Sep. 11, 2016.

(51) Int. Cl.

| | |
|---|---|
| ***H04R 1/10*** | (2006.01) |
| ***B65D 63/00*** | (2006.01) |
| ***H04R 5/033*** | (2006.01) |

(52) U.S. Cl.

CPC ..... *H04R 1/1016* (2013.01); *B65D 63/00* (2013.01); *H04R 1/105* (2013.01); *H04R 5/0335* (2013.01); *H04R 2420/07* (2013.01)

(58) Field of Classification Search

CPC ..... Y10T 24/344; Y10T 24/3444; Y10T 24/44923; H04R 1/1033; H04R 1/10; H04R 1/1016; H04R 1/105; H04R 5/033; H04R 5/0335; H04R 2420/07; B65D 63/00; F16L 3/22; F16L 3/006; F16B 2/20; F16B 2/22

(Continued)

(56) References Cited

U.S. PATENT DOCUMENTS 1,374,204 A * 4/1921 Hucle ..... A41F 19/00 24/347
1,500,684 A * 7/1924 Patrick ..... B65D 63/08 24/23 B (Continued)

OTHER PUBLICATIONS

Spigen AirPods Strap; Oct. 1, 2014 https://www.apfelkiste.ch/samsung-zubehor/samsung-tablet-zubehor/galaxy-note-10-1-2014-edition-zubehoer/galaxy-note-10-1-2014-edition-kopfhoerer-speaker/spigen-airpods-strap-halteband-weiss.html.*

(Continued)

*Primary Examiner* — Ingrid M Weinhold

(74) *Attorney, Agent, or Firm* — Heedong Chae; Lucem, PC

(57) ABSTRACT

A holding strap for wireless ear-bud style earpieces having a cylindrical or prismatic stem, includes: a pair of stem housings, each of which is constructed to form a hollow cylinder or prism having a hollow cylindrical or prismatic space to receive the cylindrical stem, wherein the hollow cylinder or prism has an inlet, an inlet rim, an outlet, and an outlet rim; a connecting strap connecting the pair of stem housings; and a strap holder for holding two places of the connecting strap. The hollow cylindrical or prismatic space is sized for the cylindrical or prismatic stem to fit in, and the stem housing is constructed so that the stem passes through the inlet, the hollow cylindrical or prismatic space and the outlet and then, the cylindrical or prismatic stem is retained in the cylindrical or prismatic space of the stem housing by a friction fit.

16 Claims, 10 Drawing Sheets

(58) Field of Classification Search
USPC ..... 248/213.2; 24/129 R, 130, 200, 122.6, 24/115 A, 115 H, 115 K; D8/395, 356
See application file for complete search history.

(56) References Cited

U.S. PATENT DOCUMENTS 2,212,862 A * 8/1940 Hirsh ..... A44B 11/04 2/268
2,276,595 A * 3/1942 Shaulson ..... A44B 11/04 24/200
2,293,562 A * 8/1942 Rosenthal ..... A44B 11/04 24/200
2,641,327 A * 6/1953 Balmer ..... H04R 1/105 181/129
2,901,801 A * 9/1959 Girodet ..... A41F 1/00 24/200
D197,065 S * 12/1963 Nilsson ..... 174/164
3,539,032 A * 11/1970 Scanlon ..... A61B 7/026 181/135
3,667,569 A * 6/1972 Mackey ..... A61B 7/026 181/131
3,910,280 A * 10/1975 Talonn ..... A61B 17/12009 24/130
3,965,540 A * 6/1976 Moore ..... F16B 2/22 248/251
D241,881 S * 10/1976 Peterson et al. ..... D24/106
3,983,602 A * 10/1976 Barry ..... A42B 3/04 224/181
D245,202 S * 7/1977 Asker ..... 128/864
4,193,396 A * 3/1980 Wacker ..... A61F 11/08 128/864
D270,329 S * 8/1983 Hardy ..... D8/356
4,406,042 A * 9/1983 McPhee ..... A61M 5/1418 24/129 A
D275,174 S * 8/1984 Rolli ..... D8/356
4,648,159 A * 3/1987 Dougherty ..... A41F 1/04 24/129 R
D291,894 S * 9/1987 Weisenfeld ..... D16/339
5,042,838 A * 8/1991 Carter ..... B60R 22/024 280/808
5,154,446 A * 10/1992 Blake ..... B60R 22/024 280/808
5,201,099 A * 4/1993 Campbell ..... A44B 11/04 24/186
5,463,189 A * 10/1995 Deneke ..... H02G 3/26 174/138 G
5,668,354 A * 9/1997 Falco ..... A61F 11/12 128/864
D394,801 S * 6/1998 Blocher ..... D8/356
5,820,095 A * 10/1998 Stone ..... B43K 23/00 248/316.7
5,845,197 A * 12/1998 Hada ..... G11B 31/00 379/430
6,158,095 A * 12/2000 Lassiter ..... F16L 3/237 24/129 R
6,307,737 B1 * 10/2001 Ogawa ..... H04N 5/64 348/843
D459,977 S * 7/2002 Byrnes ..... D8/357
D478,630 S * 8/2003 Riggins ..... D19/78
6,601,809 B1 * 8/2003 Gebrara ..... G09F 7/18 160/38
6,675,446 B2 * 1/2004 Buettell ..... G09F 21/02 24/115 H
6,782,587 B2 * 8/2004 Reilly ..... A44B 11/02 24/198
6,941,619 B2 * 9/2005 Mackay ..... G02C 3/003 24/3.3
D534,065 S * 12/2006 Andre ..... D8/395
D545,183 S * 6/2007 French ..... D8/394
D575,143 S * 8/2008 Kuo ..... D8/356
D602,763 S * 10/2009 Peterson ..... D8/354
D604,589 S * 11/2009 Johansson ..... D8/356
D607,919 S * 1/2010 Williams ..... G02C 3/003 D16/329
7,650,007 B2 * 1/2010 Iuliis ..... A45F 5/00 381/374
D625,298 S * 10/2010 Koss ..... D14/223
D633,482 S * 3/2011 Koss ..... D14/223
D644,504 S * 9/2011 Rieder ..... D8/395
D648,685 S * 11/2011 Symons ..... D13/155
8,055,005 B2 * 11/2011 Liu ..... A45F 5/00 224/247
8,139,809 B2 * 3/2012 Jubelirer ..... H04R 1/08 381/370
8,177,736 B2 * 5/2012 Kopperschmidt .. A61M 1/3653 24/335
8,295,533 B1 * 10/2012 Schachtman ..... A45F 5/00 224/257
8,708,091 B2 * 4/2014 Barwacz ..... A61F 11/08 181/135
D780,714 S * 3/2017 Vogt, Jr. ..... D14/205
D786,048 S * 5/2017 Grewal ..... H04R 1/1033 D8/356
D791,582 S * 7/2017 Nelson ..... D8/356
D794,113 S * 8/2017 Cannaliato ..... D16/339
9,949,011 B2 * 4/2018 Jen ..... H04R 1/1033
D816,636 S * 5/2018 Birger ..... D14/205
2008/0196210 A1 * 8/2008 Liu ..... A45F 5/00 24/3.4
2009/0022352 A1 * 1/2009 Weibel ..... H04R 1/1066 381/378
2009/0238395 A1 * 9/2009 Jubelirer ..... H04R 1/08 381/370
2010/0000054 A1 * 1/2010 Roser ..... H04R 1/1091 24/3.12
2010/0016037 A1 * 1/2010 Maytum ..... H04M 1/05 455/575.2
2011/0110552 A1 * 5/2011 Pang ..... H04R 1/1033 381/374
2013/0202146 A1 * 8/2013 Xue ..... H04R 1/1033 381/384
2015/0163580 A1 * 6/2015 Wallaja ..... H04R 1/1033 381/384
2015/0230019 A1 * 8/2015 Sakai ..... H04R 1/1041 381/74
2015/0232211 A1 * 8/2015 Garnache ..... F16G 11/046 29/450
2016/0025997 A1 * 1/2016 Yribarren ..... G02C 3/003 351/156
2016/0029113 A1 * 1/2016 Shen ..... H04R 1/1033 381/384
2016/0269818 A1 * 9/2016 Mackay ..... H04R 1/1033
2016/0381447 A1 * 12/2016 Kattine ..... H04R 1/105 224/183
2017/0134845 A1 * 5/2017 Milam ..... H04R 1/1041
2018/0077479 A1 * 3/2018 Johanson ..... H04R 1/105

OTHER PUBLICATIONS

Spigen Inc. Accessories; May 14, 2015 https://www.spigen.com/collections/accessories.*
Earbud Neck Straps for Athletes and the Rest of Us; Jun. 11, 2015 https://budstraps.com/.*
Horlurar—Digital inn: Feb. 25, 2015 https://www.digitalinn.se/produkter/85/horlurar.*
DHGate; Airpods Headphones anti-lost Strap Loop Rope for Apple Air Pods https://www.dhgate.com/product/capacitive-aluminium-mini-stylus-pen-for/142862937.html.*
Airpods Strap 55cm silicone Anti-lost for Apple Bluetooth earbuds; Nov. 24, 2014 https://www.aliexpress.com/store/product/Airpods-Strap-Silicone-Anti-lost-Air-Pod-Wire-Cable-for-Apple-Bluetooth-Earphone-Airpods-Accessories-Connector/2336180_32807146091.html.*

* cited by examiner

-Prior Art-

-Prior Art-

HOLDING STRAP FOR WIRELESS EAR-BUD STYLE EARPIECES HAVING A STEM

CROSS-REFERENCE TO RELATED APPLICATIONS

This application claims priority to U.S. provisional patent application No. 62/393,086, filed Sep. 11, 2016, the disclosures of which are incorporated herein by reference in their entirety.

FIELD OF THE INVENTION

The present invention relates to a holding strap for wireless ear-bud style earpieces having a stem, and more specifically a holding strap having a pair of stem housings to respectively receive the stems of the earpieces and a connecting strap. Accordingly, the holding strap connects and holds the earpieces and thus, it is easy to find the earpieces and the holding strap prevents the earpieces from being lost.

BACKGROUND OF THE INVENTION

Apple Inc.™ has introduced in September 2016 wireless earbuds or earpieces called AirPods™ 100, which is compatible with iPhone™ or iPad™. See http://www.apple.com/shop/product/MMEF2AM/A/airpods. As in FIGS. 1(*a*) and 1(*b*), AirPods™ 100 is ear-bud style earpieces 110 having a stem 120 and can be charged in a charging case 200 which has its own battery. Accordingly, if a user carries AirPods™ 100 and the charging case 200 together, he can charge his AirPods on the go.

However, wireless ear-bud style earpieces 110 having a stem 120, such as AirPods™, are small and thus, they can be hard to find and easy to lose.

The present invention is directed to overcome such disadvantage and provides a number of other advantages in using wireless ear-bud style earpieces 110 having a stem 120.

SUMMARY OF THE INVENTION

The present invention is directed to a holding strap for wireless ear-bud style earpieces having a stem. The holding strap has a pair of stem housings to respectively receive the stems of the earpieces and a connecting strap.

The object of the present invention is to provide a holding strap for wireless ear-bud style earpieces having a cylindrical stem, comprising: a pair of stem housings, each of which is constructed to form a hollow cylinder having a hollow cylindrical space to receive the cylindrical stem, wherein the hollow cylinder has an inlet, an inlet rim, an outlet, and an outlet rim; and a connecting strap connecting the pair of stem housings. The hollow cylindrical space is sized for the cylindrical stem to fit in, and the hollow cylinder is constructed so that the cylindrical stem passes through the inlet, the hollow cylindrical space and the outlet and then, the cylindrical stem is retained in the cylindrical space of the stem housing by a friction fit.

Another object of the present invention is to provide a holding strap for wireless ear-bud style earpieces having a prismatic stem, comprising: a pair of stem housings, each of which is constructed to form a hollow prism having a hollow prismatic space to receive the prismatic stem, wherein the hollow prism has an inlet, an inlet rim, an outlet, and an outlet rim; and a connecting strap connecting the pair of stem housings. The hollow prismatic space is sized for the prismatic stem to fit in, and the stem housing is constructed so that the prismatic stem passes through the inlet, the hollow prismatic space and the outlet and then, the prismatic stem is retained in the prismatic space of the stem housing by a friction fit.

Still another object of the present invention is to provide a strap holder for holding two places of a connecting strap, including connecting cable or cord, together, comprising: a first space and a second space for respectively receiving first and second places of the connecting strap; a first entry space and a second entry space; a dividing wall which is located between the first and second spaces; first side walls and second side walls; and first flange walls formed on both sides of the first entry space and a second flange wall abutting the second entry space. The first and second spaces are sized for the connecting strap to fit in and be retained therein by a friction fit. Preferably, the height of the first side walls and the first flange walls is greater than the height of the second side walls and the second flange wall.

The advantages of the present invention are: (1) because of the holding strap of the present invention, it is easy to find the earpieces and the holding strap prevents the earpieces from being lost; (2) the stem housing of the present invention well retains the stem of the earpiece and does not block the microphone formed on the end of the stem of the earpiece; (3) the holding strap of the present invention has a simple structure but provides a number of benefits; (4) due to such simple structure of the present invention, it is easy to manufacture—one shot molding is possible—and the manufacturing cost is reduced; (5) it is easy to insert and remove the stem of the earpiece into or from the stem housing of the present invention; (6) due to the different heights in the dividing wall, the strap holder of the present invention well retains the connecting strap together and it is easy to put the connecting strap in or pull it out of the strap holder; (7) due to the clip, the holding strap of the present invention can be wound about the charging stand or charging station and retained thereto so that a user can carry the holding strap together with the earpieces stored in the charging case.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 1(*b*) shows AirPods™ and the charging case;

FIG. 5(*b*) shows the present invention wrapped around the charging case;

FIG. 6(*b*) shows a cross-sectional view of the strap holder according to another embodiment of the present invention;

FIG. 6(*c*) shows a cross-sectional view of the strap holder according to another embodiment of the present invention; and FIG. 6(*d*) shows a cross-sectional view of the strap holder according to another embodiment of the present invention.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1A:
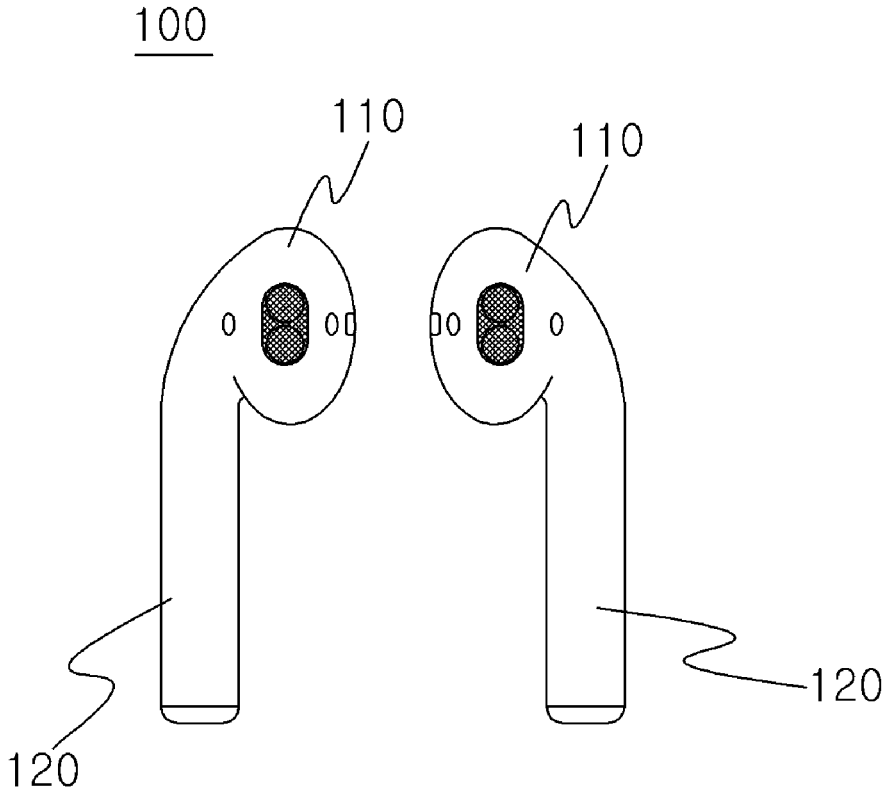
FIG. 1(*a*) shows Apple Inc.™'s AirPods™.
Figure 1B:
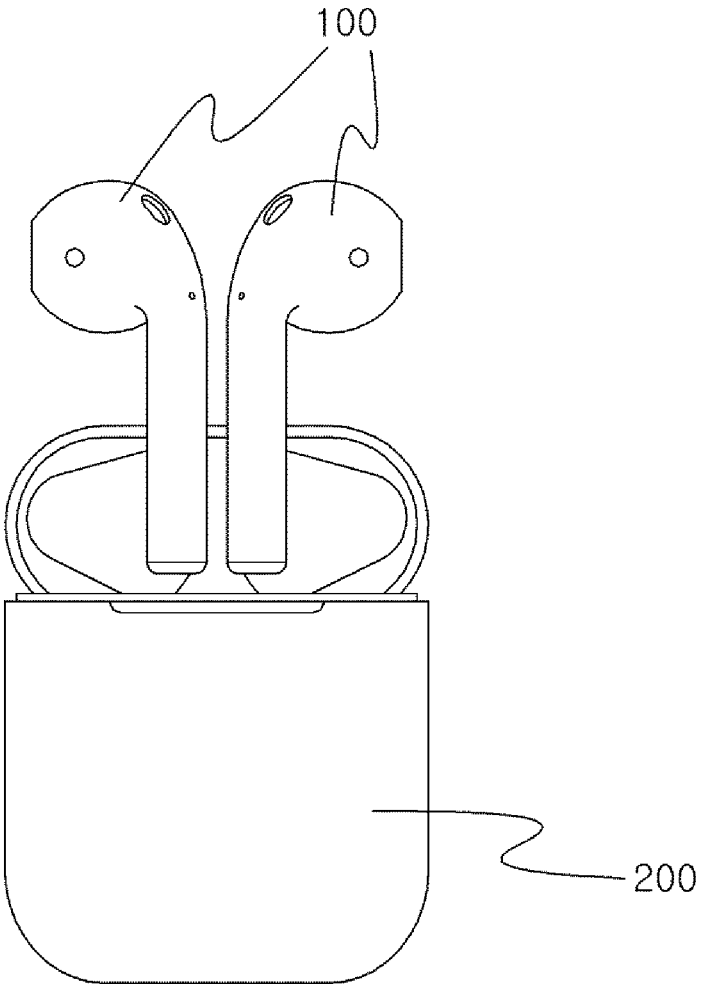
Figure 2A:
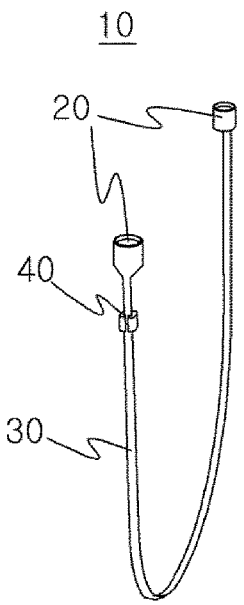
FIGS. 2(*a*)-2(*c*) show one embodiment of the present invention.
Figure 2B:
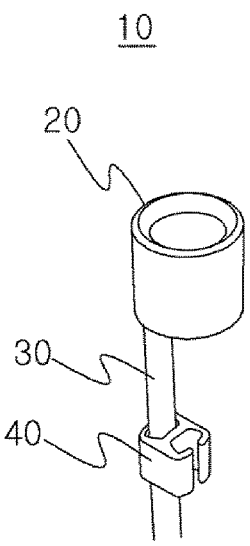
Figure 2C:
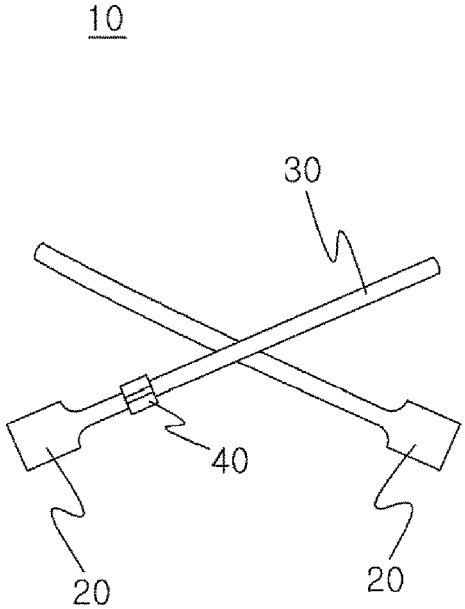

FIG. 1(*a*) shows Apple Inc.™'s AirPods™ 100 and FIG. 1(*b*) shows AirPods™ 100 and the charging case 200. The holding strap 10 of the present invention is intended for wireless ear-bud style earpieces, having a stem, such as AirPods™. The holding strap 10 has a pair of stem housings 20 to respectively receive the stems 120 of the earpieces 110 and a connecting strap 30. Accordingly, the holding strap 10 connects and holds the earpieces 110 and thus, it is easy to find the earpieces 100 and the holding strap 10 prevents the earpieces 100 from being lost.

Figure 5A:
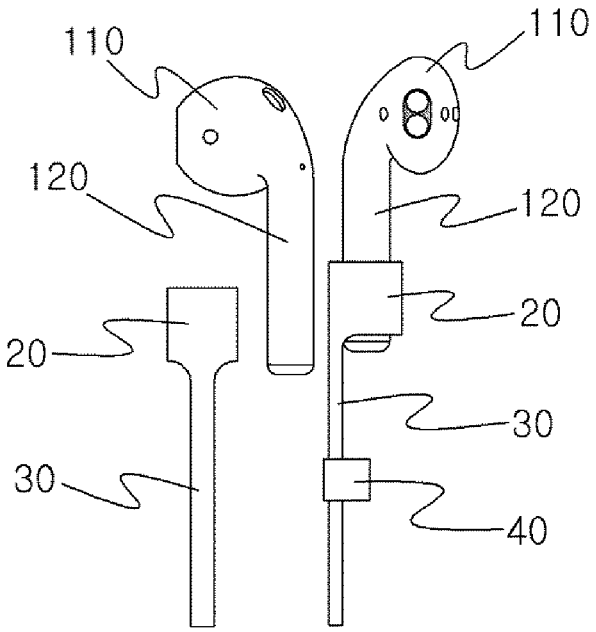
FIG. 5(*a*) shows AirPods™ and the stem housings of the present invention.
Figure 5B:
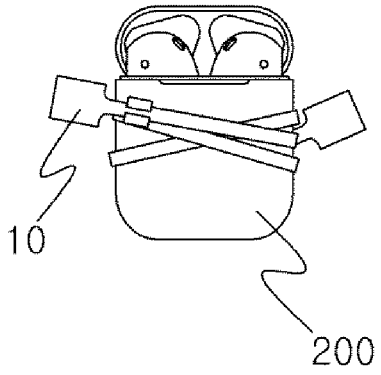
Figure 6A:
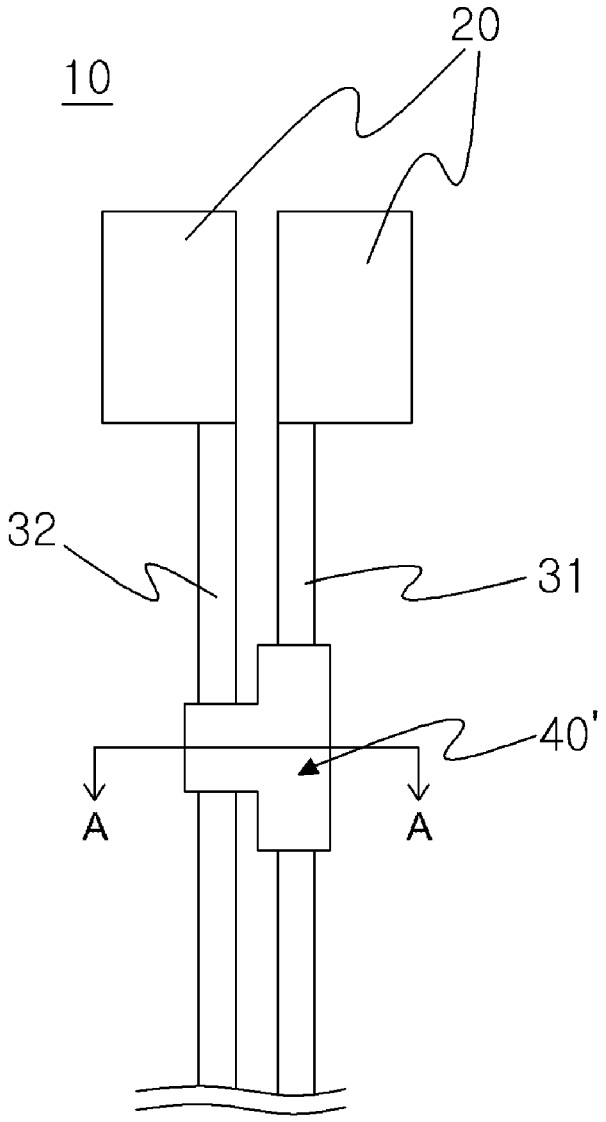
FIG. 6(*a*) shows another embodiment of the present invention.
Figure 6B:
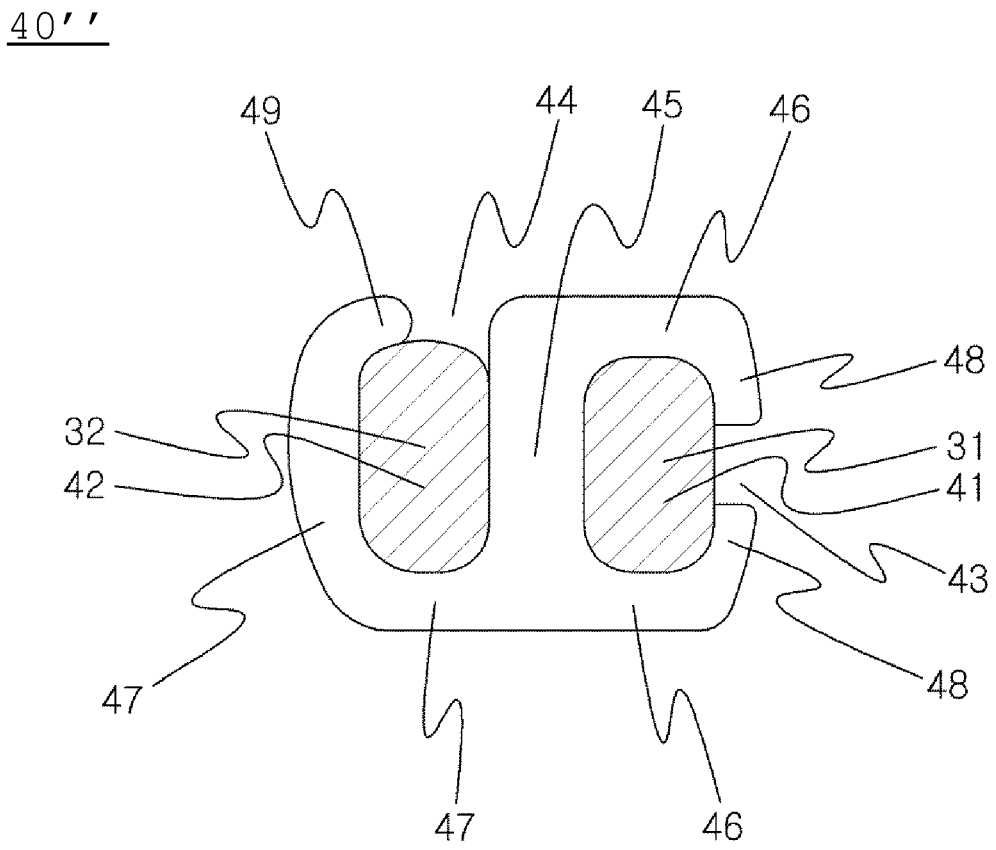
Figure 6C:
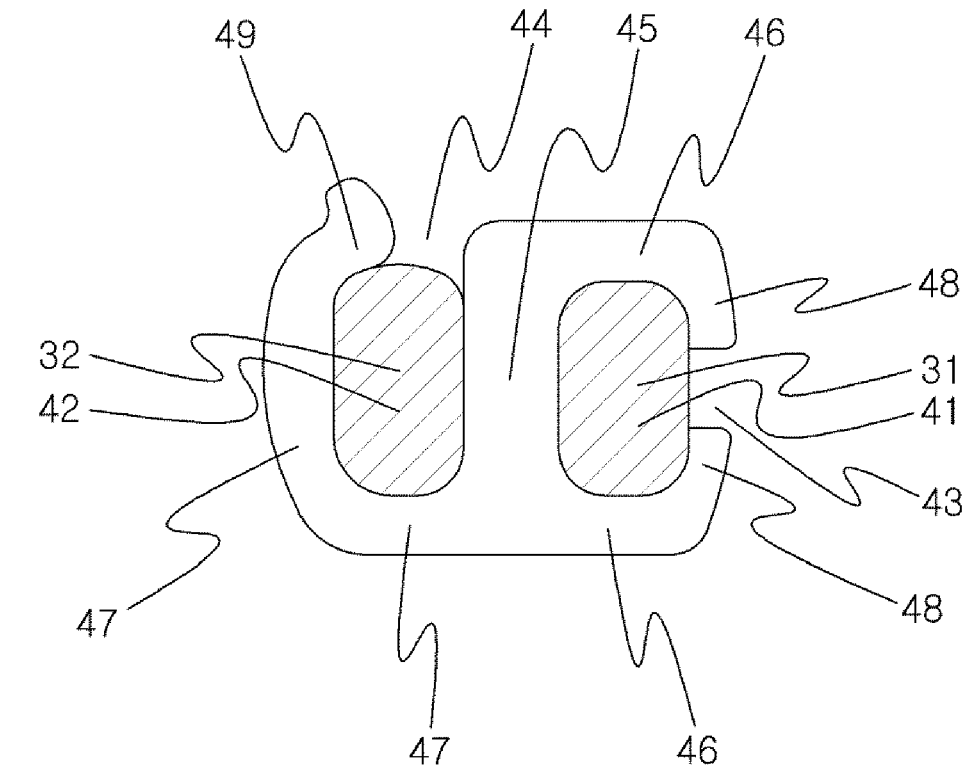
Figure 6D:
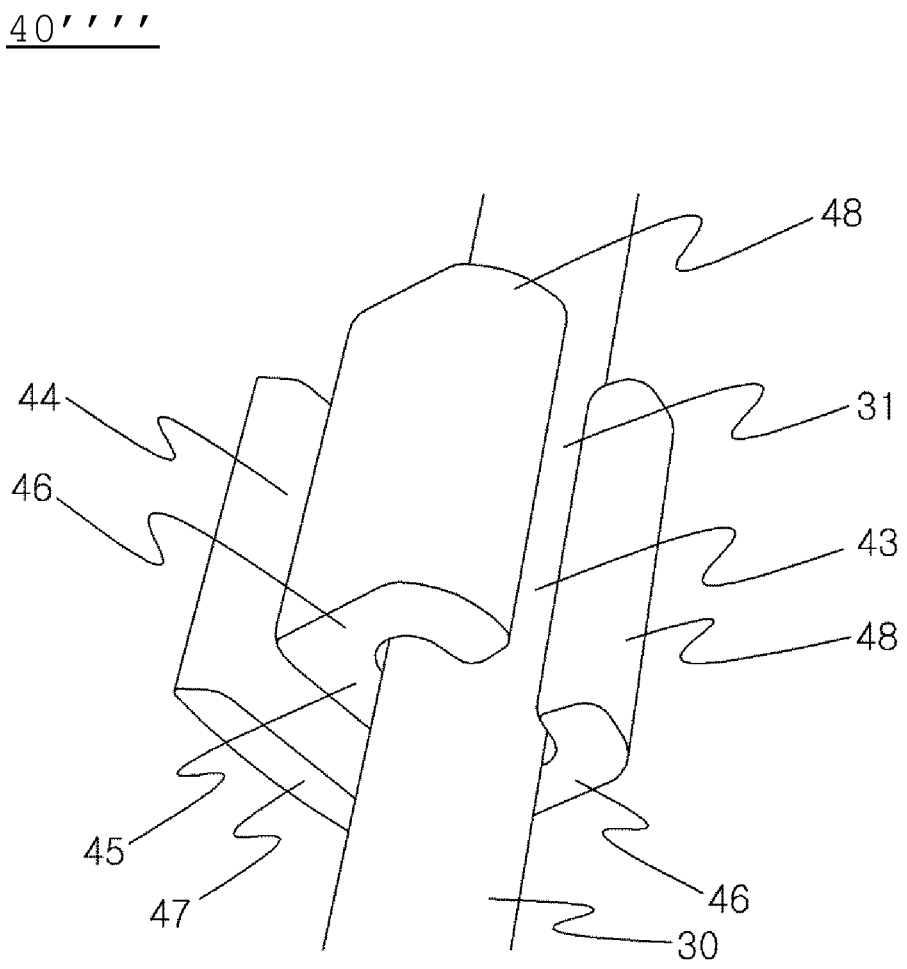

A holding strap 10 for wireless ear-bud style earpieces 110, having a cylindrical stem 120, comprises: a pair of stem housings 20, each of which is constructed to form a hollow cylinder 20 having a hollow cylindrical space 25 to receive the cylindrical stem 120, wherein the hollow cylinder 20 has an inlet 21, an inlet rim 22, an outlet 23, and an outlet rim 24; and a connecting strap 30 connecting the pair of stem housings 20. The hollow cylindrical space 25 is sized for the cylindrical stem 120 to fit in as shown in FIG. 5(*a*). The hollow cylindrical space 25 does not necessarily receive the whole height of the stem 120. The hollow cylinder 20 or the hollow cylindrical space 25 is constructed so that the cylindrical stem 120 passes through the inlet 21, the hollow cylindrical space 25 and the outlet 23 and then, the cylindrical stem 120 is retained in the cylindrical space 25 of the stem housing 20 by a friction fit. In this structure, one end of the cylindrical stem 120 can be exposed. A microphone is usually installed at the end of the cylindrical stem 120 and thus, the holding strap 10 should not block the end of the cylindrical stem 120.

Here, "cylinder" for the meaning of "cylindrical" means a geometric figure with substantially straight parallel sides and substantially circular or oval cross section. The stem 120 is cylindrical and thus, the hollow space 25 is cylindrical as well so that the stem 120 can pass through the inlet 21, hollow space 25 and outlet 23. However, the present invention is not limited to such cylindrical configuration. The hollow space 25 may be constructed to correspond to different shapes of the stem in order to receive and retain the stem 120 therein.

Figure 3A:
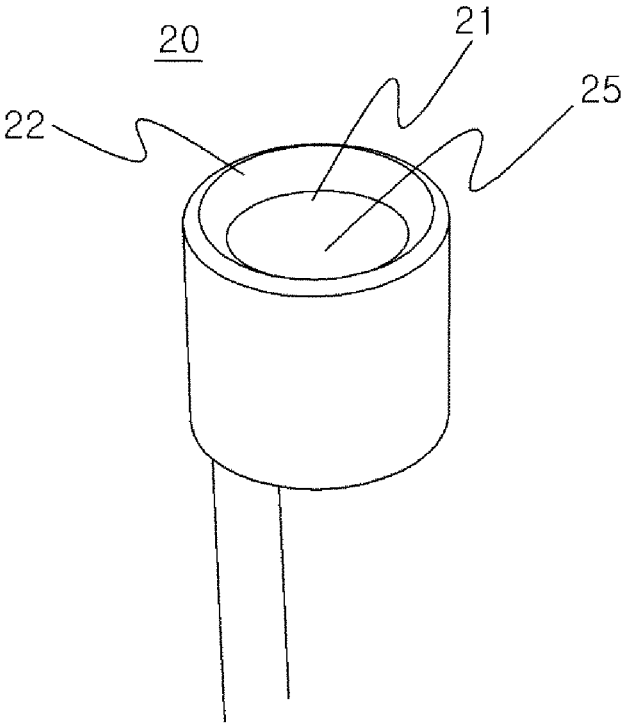
FIGS. 3(*a*)-3(*b*) show perspective views of the stem housing of the present invention.
Figure 3B:
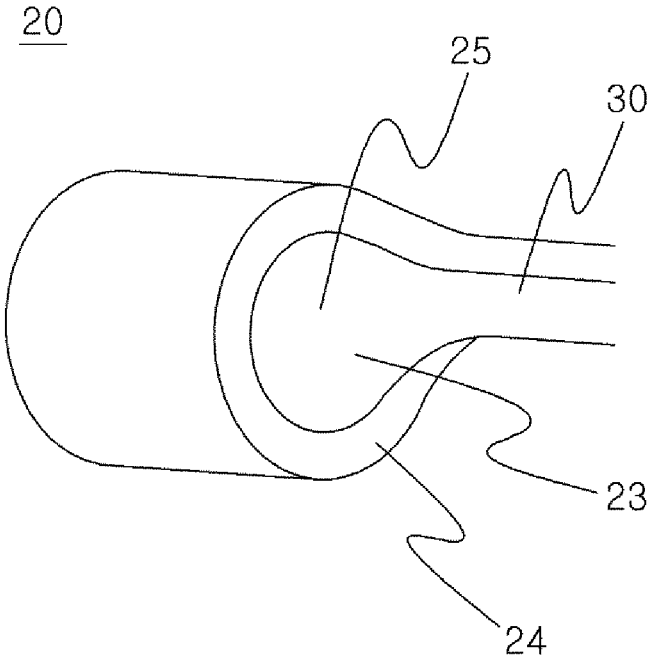

As shown in FIG. 3(*a*), the inlet rim 22 of the stem housing 20 may be tapered toward the hollow cylindrical space 25 for easy insertion of the cylindrical stem 120 into the hollow cylindrical space 25.

The connecting strap 30 is preferably flat. Here, "flat" means the thickness of the connecting strap 30 is substantially smaller than the width of the connecting strap 30 in cross-sectional view of the connecting strap 30. The cross-sectional view of the connecting strap 30 may be rectangular or substantially rectangular, but not necessarily in a rectangular shape as long as it has two substantially parallel opposite sides.

In addition, the connecting strap 30 may be constructed to extend from the outlet rim 24 of the stem housing 20 as in FIG. 3(*b*). The connecting strap 30 is constructed not to interfere with the stem 120 coming out of the outlet 23. The area of the connecting strap 30 extending from the outlet rim 24 and abutting the stem 120 may be rounded, corresponding to the cylindrical shape of the stem 120, and in contact with the stem 120.

The pair of stem housings 20 and the connecting strap 30 may be made of soft material such as rubber or silicone or other soft flexible plastic. Preferably, the pair of stem housings 20 and the connecting strap 30 are made of thermoplastic elastomer (TPE), silicone or thermoplastic polyurethane (TPU), or more preferably, made of TPE. The pair of stem housings 20 and the connecting strap 30 may be made of mixture of two or more materials of thermoplastic elastomer (TPE), silicone or thermoplastic polyurethane (TPU), including mixture of thermoplastic polyurethane and silicone.

The holding strap 10 may further comprise a length adjusting means (not shown) for adjusting the length of the connecting strap 30. Such length adjusting means is well known in the art.

The holding strap 10 may further comprise a clip (not shown) for holding the wound connecting strap 30 together. Such clip is well known in the art. Preferably, the clip is provided with an adhesive for attaching the clip to a charging case 200. The holding strap 10 can be wound around the charging case 200 and held together by the clip. The adhesive can be any type of adhesives, including glue or double-sided tape. FIG. 5(*b*) shows the holding strap 10 wound around the charging case 200.

Figure 4A:
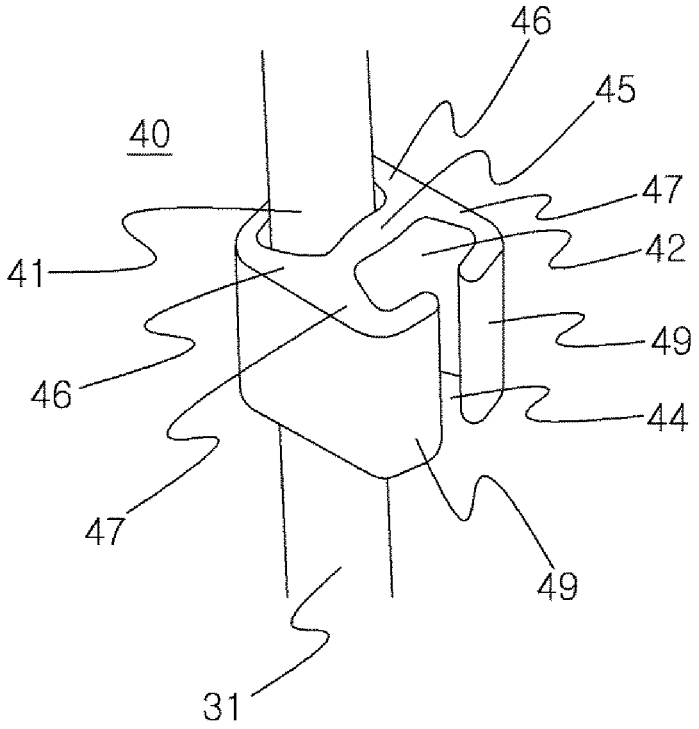
FIGS. 4(*a*)-4(*b*) show the strap holder according to one embodiment of the present invention.
Figure 4B:
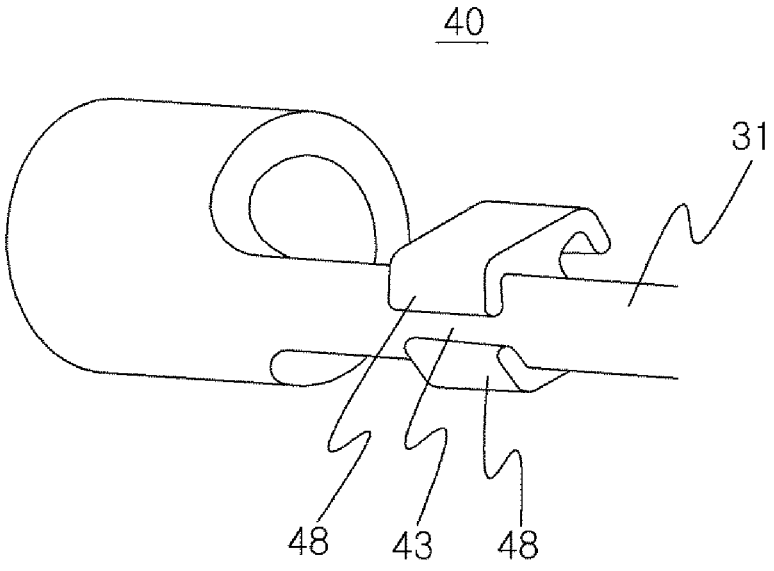

The holding strap 10 may further comprise a strap holder 40 for holding two places of the connecting strap 30 together to adjust the length of the connecting strap 30. FIGS. 4(*a*) and 4(*b*) show the strap holder 40 of the present invention.

The strap holder 40 may comprise: a first space 41 and a second space 42 for respectively receiving first and second places 31, 32 of the connecting strap 30; a first entry space 43 and a second entry space 44 wherein the first and second places 31, 32 of the connecting strap 30 respectively enter the first entry space 43 and the second entry space 44 to be retained in the first space 41 and the second space 42; a dividing wall 45 which is located between the first and second spaces 41, 42; first side walls abutting opposite sides of the first space 41; first flange walls 48 formed on both sides of the first entry space 43; second side walls 47 abutting the second space 42; and a second flange wall 49 abutting one side of the second entry space wherein the dividing wall 45 abuts the other side of the second entry space 44. The first and second spaces 41, 42 are sized for the connecting strap 30 to fit in and be retained therein by a friction fit.

In the alternative embodiment, there may be a pair of second flange walls 49 formed on both sides of the second entry space 44 as shown in FIGS. 4(*a*) and 4(*b*). There are two second flange walls 49 as in FIGS. 4(*a*) and 4(*b*). However, there is only one second flange wall 49 as in FIG. 6(*b*) or 6(*c*). In FIG. 6(*d*), there is no second flange wall.

As in FIG. 4(*a*) or 4(*b*), the strap holder 40 may further comprise a second flange wall 49 abutting one side of the second entry space 44 and the dividing wall 45 may abut the other side of the second entry space 44. In this embodiment, the second place 32 is easier to slide in or pull out of the second space 42 than the first place 31 in or out of the first space 41. The embodiment of FIG. 6(*d*) also has this advantage.

The connecting strap 30 may be flat and a width of the connecting strap 30 may be greater than a thickness of the connecting strap 30, and the first and second entry spaces 43, 44 may be sized to allow insertion of the connecting strap 30 in width direction, but not to allow insertion of the connecting strap 30 in thickness direction. In other words, the first and second entry spaces 43, 44 are sized about the thickness of the connecting strap 30, or substantially same size or slightly greater or smaller than the thickness. Accordingly, the connecting strap 30 can be inserted into the first and second spaces 41, 42, and after the insertion, it can be securely retained therein by a friction fit.

In preferred embodiment illustrated in FIG. 6(*a*), the height of the first side walls 46 and the first flange walls 48 is greater than the height of the second side walls 47 and the second flange wall 49. In this embodiment, the first place 31 of the connecting strap 30 can be retained in the strap holder 40' more securely than the second place 32 of the connecting strap 30 because of the greater height of the dividing wall 45. Because of this construction, the first place 31 can be retained in the strap holder 40' and only the second place 32 is inserted into and pulled out of the strap holder 40'. When the first and second places 31, 32 are spread out, only second place 32 is pulled out of the strap holder 40'. Additionally, a height of the dividing wall 45 abutting the first space 41 may be greater than a height of the dividing wall 45 abutting the second space 42 as illustrated in FIG. 6(*a*).

There may be only one second flange wall 49 as in FIG. 6(*b*) or 6(*c*), or there may be two second flange walls (49) as in FIG. 4(*a*). In the embodiments of FIG. 6(*b*) or 6(*c*), the receiving directions of the first and second places 31, 32 are different. The first place 31 is harder to be inserted into the first space 41 than the second place 32 into the second space 42, but the first place 31 is more securely held in the first space 41 than the second place 32 held in the second space 42. Accordingly, it is possible that only the second place 32 is inserted into or pulled out of the second space 42 while the first place 31 remains in the first space 41. Thus, the strap holder 40 (40" as shown in FIG. 6(*b*) and 40''' as shown in FIG. 6(*c*)) is less likely to be lost and it is convenient for a user to use the strap holder 40 for the connecting strap 30.

In the construction of FIG. 6(*b*) or 6(*c*) coupled with the height difference in FIG. 6(*a*), the first place 31 is even harder to be inserted into the first space 41 than the second place 32 into the second space 42, but the first place 31 is even more securely held in the first space 41 than the second place 32 held in the second space 42.

As in FIG. 6(*c*), the end of the second flange wall 49 may be curved outwardly for easy insertion of the second place 32 into the second space 42.

Alternatively, there may be no second flange wall 49 for the strap holder 40'''' as shown in FIG. 6(*d*). The height of the first side walls 46 and the first flange walls 48 may be about the same as the height of the second side walls 47. This construction is easy to manufacture and thus, the manufacturing cost is low. In addition, the second place 32 can be easily inserted into the second space 42.

In the alternative embodiment, the present invention is not limited to such cylindrical configuration, and the hollow space 25 may be constructed to correspond to the shape of the stem in order to receive and retain the stem 120 therein. For example, the stem 120 may be prismatic and the hollow space 25 may be prismatic as well.

Here, the holding strap 10 for wireless ear-bud style earpieces 110 having a prismatic stem 120, comprises: a pair of stem housings 20, each of which is constructed to form a hollow prism 20 having a hollow prismatic space 25 to receive the prismatic stem 120, wherein the hollow prism 20 has an inlet 21, an inlet rim 22, an outlet 23, and an outlet rim 24; and a connecting strap 30 connecting the pair of stem housings 20. The hollow prismatic space 25 is sized for the prismatic stem 120 to fit in. The stem housing 20 is constructed so that the prismatic stem 120 passes through the inlet 21, the hollow prismatic space 25 and the outlet 23 and then, the prismatic stem 120 is retained in the prismatic space 25 of the stem housing 20 by a friction fit.

Here, prismatic or prism means a geometric figure with substantially straight parallel sides and substantially parallelogramic sides, paralleglogramic meaning four-sided shape with opposite sides substantially parallel. The prism may be triangular prism, rectangular prism, cube, pentagonal prism, hexagonal prism, or the like. The cross sectional view can be triangular, rectangular, square, pentagonal, hexagonal, or in other various shapes, as long as the stem 120 is prismatic and the hollow space 25 is of a corresponding shape to receive the stem 120 therein.

The inlet rim 22 of the stem housing 20 may be tapered toward the hollow prismatic space 25 for easy insertion of the prismatic stem 120 into the hollow prismatic space 25.

The connecting strap 30 may be flat and constructed to extend from the outlet rim 24 of the stem housing 20. In addition, the area of the connecting strap 30 extending from the outlet rim 24 and abutting the stem 120 may correspond to the shape of the prismatic stem 120 and be in contact with the stem 120.

The holding strap 10 may further comprise a strap holder 40 for holding two places of the connecting strap 30 together. The strap holder 40 may have the structure as described above. The strap holder 40 may comprise: a first space 41 and a second space 42 for respectively receiving first and second places 31, 32 of the connecting strap 30; a first entry space 43 and a second entry space 44 for the first and second places 31, 32 of the connecting strap 30 respectively to enter the first entry space 43 and the second entry space 44 for being respectively retained in the first space 41 and the second space 42; a dividing wall 45 which is located between the first and second spaces 41, 42; first side walls 46 abutting opposite sides of the first space 41; first flange walls 48 formed on both sides of the first entry space 43; and second side walls 47 abutting the second space 42 such that the second side walls 47 form an "L"-shaped wall extending from the dividing wall 45. The first and second spaces 41, 42 are sized for the connecting strap 30 to fit in and be retained therein by a friction fit.

In the alternative embodiment, there may be a pair of second flange walls 49 formed on both sides of the second entry space 44 as shown in FIGS. 4(*a*) and 4(*b*). There are two second flange walls 49 as in FIGS. 4(*a*) and 4(*b*). However, there is only one second flange wall 49 as in FIG. 6(*b*) or 6(*c*). In FIG. 6(*d*), there is no second flange wall.

As in FIG. 4(*a*) or 4(*b*), the strap holder 40 may further comprise a second flange wall 49 abutting one side of the second entry space 44 and the dividing wall 45 may abut the other side of the second entry space 44. In this embodiment, the second place 32 is easier to slide in or pull out of the second space 42 than the first place 31 in or out of the first space 41. The embodiment of FIG. 6(*d*) also has this advantage.

Alternatively, there may be no second flange wall 49 as shown in FIG. 6(*d*). The height of the first side walls 46 and the first flange walls 48 may be about the same as the height of the second side walls 47. This construction is easy to manufacture and thus, the manufacturing cost is low. In addition, the second place 32 can be easily inserted into the second space 42.

The connecting strap 30 is flat and a width of the connecting strap 30 is greater than a thickness of the connecting strap 30, and the first and second entry spaces 43, 44 are sized to allow insertion of the connecting strap 30 in width direction, but not to allow insertion of the connecting strap 30 in thickness direction. Preferably, the height of the first side walls 46 and the first flange walls 48 may be greater than the height of the second side walls 47 and the second flange wall 49. Additionally, the height of the dividing wall 45 abutting the first space 41 is greater than the height of the dividing wall 45 abutting the second space 42.

The present invention includes the strap holder 40 on its own to be used for any kind of cable, cord or strap.

The strap holder 40 for holding two places of a connecting strap 30, including connecting cable or cord, together, may comprise: a first space 41 and a second space 42 for respectively receiving first and second places 31, 32 of the connecting strap 30; a first entry space 43 and a second entry space 44 wherein the first and second places 31, 32 of the connecting strap 30 respectively enter the first entry space 43 and the second entry space 44 to be retained in the first space 41 and the second space 42; a dividing wall 45 which is located between the first and second spaces 41, 42; first side walls 46 abutting opposite sides of the first space 41; first flange walls 48 formed on both sides of the first entry space 43; and second side walls 47 abutting the second space 42 wherein the second side walls 47 form an "L"-shaped wall extending from the dividing wall 45. The first and second spaces 41, 42 are sized for the connecting strap 30 to fit in and be retained therein by a friction fit.

In addition, the connecting strap 30 is flat and a width of the connecting strap 30 is greater than a thickness of the connecting strap 30, and the first and second entry spaces 43, 44 are sized to allow insertion of the connecting strap 30 in width direction, but not to allow insertion of the connecting strap 30 in thickness direction. Furthermore, the strap holder 40 may further comprise a second flange wall 49 abutting one side of the second entry space 44, and the dividing wall 45 may abut the other side of the second entry space 44.

The height of the first side walls 46 and the first flange walls 48 may be greater than the height of the second side walls 47 and the second flange wall 49.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A holding strap (10) detachably coupled to ear-bud style earpieces (110) having a cylindrical stem (120), the holding strap (10) comprising:

a pair of stem housings (20), each of which is constructed to form a hollow cylinder (20) having a hollow cylindrical space (25) to receive the cylindrical stem (120), wherein the hollow cylinder (20) has an inlet (21), an inlet rim (22), an outlet (23), and an outlet rim (24); and a connecting strap (30) extending directly from each of the stem housings (20) and connecting the pair of stem housings (20), wherein the hollow cylindrical space (25) is constructed to receive the cylindrical stem (120) to fit in, wherein the hollow cylinder (20) is constructed so that the cylindrical stem (120) passes through the inlet (21), the hollow cylindrical space (25) and the outlet (23) and then, the cylindrical stem (120) is retained in the cylindrical space (25) of the stem housing (20) by a friction fit, wherein the connecting strap (30) is flat and constructed to extend from the outlet rim (24), and wherein an area of the connecting strap (30) that extends from the outlet rim (24) and abuts the stem (120) is rounded to correspond to the shape of the cylindrical stem (120) and be in contact with the stem (120).

2. The holding strap (10) of claim 1, wherein the inlet rim (22) is tapered toward the hollow cylindrical space (25) to allow insertion of the cylindrical stem (120) into the hollow cylindrical space (25).

3. The holding strap (10) of claim 1, wherein the pair of stem housings (20) and the connecting strap (30) are made of thermoplastic elastomer, thermoplastic polyurethane, or mixture of thermoplastic polyurethane and silicone.

4. The holding strap (10) of claim 1, further comprising a clip for holding the connecting strap (30) together when the connecting strap is wound.

5. The holding strap (10) of claim 4, wherein the clip is configured to attach to a charging case (200) using an adhesive.

6. The holding strap (10) of claim 1, further comprising a strap holder (40) for holding two places of the connecting strap (30) together, wherein the strap holder (40) comprises:

a first space (41) and a second space (42) for respectively receiving first and second places (31, 32) of the connecting strap (30);

a first entry space (43) and a second entry space (44) wherein the first and second places (31, 32) of the connecting strap (30) respectively enter the first entry space (43) and the second entry space (44) to be retained in the first space (41) and the second space (42);

a dividing wall (45) which is located between the first and second spaces (41, 42);

first side walls (46) abutting opposite sides of the first space (41);

first flange walls (48) formed on both sides of the first entry space (43); and second side walls (47) abutting the second space (42) wherein the second side walls (47) form an "L"-shaped wall extending from the dividing wall (45), wherein the first and second spaces (41, 42) are sized for the connecting strap (30) to fit in and be retained therein by a friction fit.

7. The holding strap (10) of claim 6, wherein the strap holder (40) further comprises a second flange wall (49)

abutting one side of the second entry space (44), wherein the dividing wall (45) abuts another side of the second entry space (44).

8. The holding strap (10) of claim 6, wherein the connecting strap (30) comprises first faces and second faces, wherein a width of the first faces is greater than a width of the second faces, wherein the first and second entry spaces (43, 44) have opening widths less than the width of the first faces, and the opening widths of the first and second entry spaces (43, 44) are sized to receive the width of the second faces, of which, allow insertion of the connecting strap (30) into the first and second entry spaces (43, 44).

9. The holding strap (10) of claim 6, wherein a height of the first side walls (46) and the first flange walls (48) is greater than a height of the second side walls (47) and a second flange wall (49).

10. A holding strap (10) detachably coupled to ear-bud style earpieces (110) having a stem (120) that is substantially cylindrical, the holding strap (10) comprising:

a pair of stem housings (20), each of which is constructed to form a hollow body (20) having a hollow space (25) to receive the stem (120), wherein the hollow body (20) has an inlet (21), an inlet rim (22), an outlet (23), and an outlet rim (24); and a connecting strap (30) extending directly from each of the stem housings (20) and connecting the pair of stem housings (20), wherein the hollow space (25) is substantially cylindrical, wherein the hollow space (25) is constructed to receive the stem (120) to fit in, wherein the hollow body (20) is constructed so that the stem (120) passes through the inlet (21), the hollow space (25) and the outlet (23) and then, the stem (120) is retained in the space (25) of the stem housing (20) by a friction fit, and wherein the connecting strap (30) is flat and constructed to extend from the outlet rim (24), and wherein an area of the connecting strap (30) that extends from the outlet rim (24) and abuts the stem (120) is substantially rounded to correspond to the shape of the stem (120) and be in contact with the stem (120).

11. The holding strap (10) of claim 10, wherein the inlet rim (22) is tapered toward the hollow space (25) to allow insertion of the stem (120) into the hollow space (25).

12. The holding strap (10) of claim 10, wherein the pair of stem housings (20) and the connecting strap (30) are made of thermoplastic elastomer, thermoplastic polyurethane, or mixture of thermoplastic polyurethane and silicone.

13. The holding strap (10) of claim 10, further comprising a clip for holding the connecting strap (30) together when the connecting strap is wound.

14. The holding strap (10) of claim 13, wherein the clip is configured to attach to a charging case (200) using an adhesive.

15. The holding strap (10) of claim 10, further comprising a strap holder (40) for holding two places of the connecting strap (30) together, wherein the strap holder (40) comprises:

a first space (41) and a second space (42) for respectively receiving first and second places (31, 32) of the connecting strap (30);

a first entry space (43) and a second entry space (44) wherein the first and second places (31, 32) of the connecting strap (30) respectively enter the first entry space (43) and the second entry space (44) to be retained in the first space (41) and the second space (42);

a dividing wall (45) which is located between the first and second spaces (41, 42);

first side walls (46) abutting opposite sides of the first space (41);

first flange walls (48) formed on both sides of the first entry space (43); and second side walls (47) abutting the second space (42)

wherein the second side walls (47) form an "L"-shaped wall extending from the dividing wall (45), wherein the first and second spaces (41, 42) are sized for the connecting strap (30) to fit in and be retained therein by a friction fit.

16. The holding strap (10) of claim 15, wherein the connecting strap (30) comprises first faces and second faces, wherein a width of the first faces is greater than a width of the second faces, wherein the first and second entry spaces (43, 44) have opening widths less than the width of the first faces, and the opening widths of the first and second entry spaces (43, 44) are sized to receive the width of the second faces, of which, allow insertion of the connecting strap (30) into the first and second entry spaces (43, 44).

* * * * *